US007556162B2

(12) United States Patent
Myhre

(10) Patent No.: US 7,556,162 B2
(45) Date of Patent: Jul. 7, 2009

(54) METHOD FOR PROVIDING A HINGED GUARANTEE CLOSURE, A HINGED GUARANTEE CLOSURE AND CONTAINER WITH A HINGED GUARANTEE CLOSURE

(76) Inventor: Svein Myhre, Båtstangveien 87, Sandefjord (NO) N-3230

( * ) Notice: Subject to any disclaimer, the term of this patent is extended or adjusted under 35 U.S.C. 154(b) by 227 days.

(21) Appl. No.: 10/501,119

(22) PCT Filed: Jan. 17, 2003

(86) PCT No.: PCT/NO03/00015

§ 371 (c)(1),
(2), (4) Date: Jul. 12, 2004

(87) PCT Pub. No.: WO03/059772

PCT Pub. Date: Jul. 24, 2003

(65) Prior Publication Data

US 2005/0115968 A1 Jun. 2, 2005

(51) Int. Cl.
*B65D 41/10* (2006.01)

(52) U.S. Cl. ..... 215/235; 215/253; 220/259.1; 220/837

(58) Field of Classification Search ..... 220/259.1, 220/268, 847, 837; 215/235, 253
See application file for complete search history.

(56) References Cited

U.S. PATENT DOCUMENTS

| | | | | | |
|---|---|---|---|---|---|
| 1,497,190 | A | | 6/1924 | Moland | |
| 1,589,913 | A | | 6/1926 | Wells | |
| 1,928,445 | A | * | 9/1933 | Boyd | 220/838 |
| 2,961,119 | A | * | 11/1960 | Leach | 220/291 |
| 3,247,548 | A | | 4/1966 | Fields et al. | |
| 4,103,803 | A | | 8/1978 | Irvine | |
| 4,487,324 | A | | 12/1984 | Ostrowsky | |
| 4,903,870 | A | * | 2/1990 | La Vange | 222/482 |
| 4,911,324 | A | * | 3/1990 | Dubach | 220/838 |
| 5,016,777 | A | * | 5/1991 | Marvin | 220/839 |
| 5,335,802 | A | * | 8/1994 | Brach et al. | 215/235 |
| 5,358,151 | A | * | 10/1994 | Strasenburgh | 222/420 |
| 5,494,185 | A | * | 2/1996 | Dubach | 220/838 |
| 5,540,343 | A | * | 7/1996 | Schumacher | 215/235 |
| 5,558,239 | A | * | 9/1996 | Dubach | 215/235 |
| 5,605,240 | A | * | 2/1997 | Guglielmini | 215/256 |
| 5,779,110 | A | * | 7/1998 | Brown et al. | 222/556 |
| 5,853,093 | A | * | 12/1998 | Neiger | 215/237 |
| 5,875,907 | A | | 3/1999 | Lay | |
| 5,934,496 | A | * | 8/1999 | Mogard et al. | 220/258.3 |

(Continued)

FOREIGN PATENT DOCUMENTS

| | | |
|---|---|---|
| DE | 43 38 090 | 5/1995 |

(Continued)

*Primary Examiner*—Anthony D Stashick
*Assistant Examiner*—Christopher B McKinley
(74) *Attorney, Agent, or Firm*—Volpe and Koenig, P.C.

(57) ABSTRACT

A hinged guarantee closure is produced by being injection moulded in the closed state, i.e., with a guarantee seal. The closure is injection moulded with an associated ring member for connection to the container on which the closure is to be used. The ring member is separated from the rest of the closure by an axial gap which is spanned by a hinge portion and a guarantee connection. The closure comprises a cap with an integral closing member for cooperation with an opening in the container.

19 Claims, 6 Drawing Sheets

U.S. PATENT DOCUMENTS

| | | | | |
|---|---|---|---|---|
| 5,944,207 | A * | 8/1999 | Reidenbach | 215/243 |
| 5,992,659 | A * | 11/1999 | Nofer et al. | 215/235 |
| 6,253,937 | B1 * | 7/2001 | Anderson | 215/235 |
| 6,460,712 | B2 * | 10/2002 | Smith et al. | 215/235 |
| 2002/0104843 | A1 * | 8/2002 | Smith et al. | 220/270 |
| 2003/0062369 | A1 * | 4/2003 | Hierzer et al. | 220/259.1 |
| 2003/0205549 | A1 * | 11/2003 | Harrold et al. | 215/230 |
| 2005/0115968 | A1 * | 6/2005 | Myhre | 220/259.1 |

FOREIGN PATENT DOCUMENTS

| | | |
|---|---|---|
| DE | 29512523 | 11/1995 |
| DE | 19734874 | 2/1999 |
| DE | 20111584 | 11/2001 |
| EP | 0 141 591 | 5/1985 |
| JP | 6506425 | 7/1994 |
| JP | 3029460 | 1/2009 |
| WO | 9014286 | 11/1990 |
| WO | 94/01338 | 1/1994 |
| WO | 00/44638 | 8/2000 |

* cited by examiner

Fig. 4
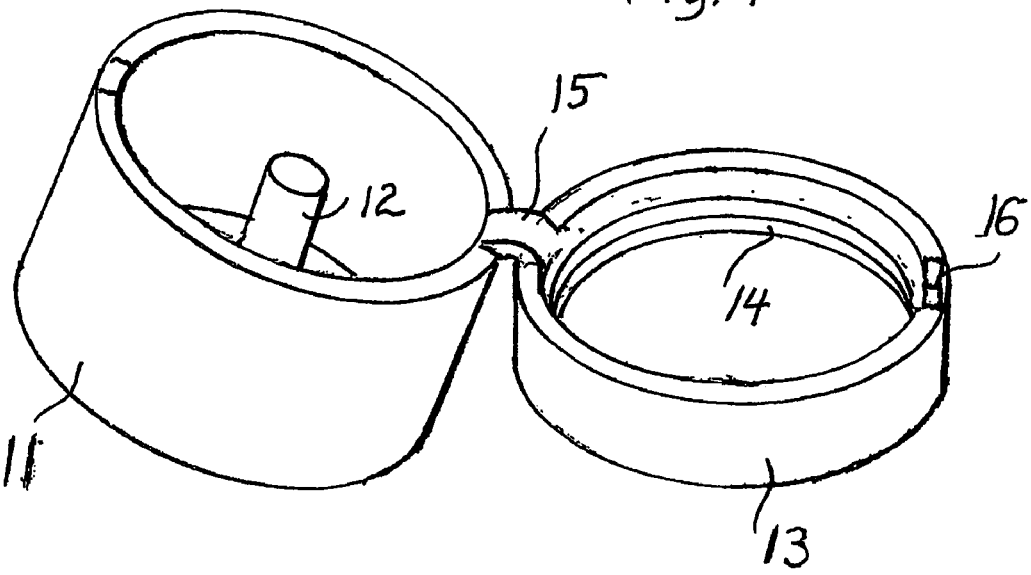
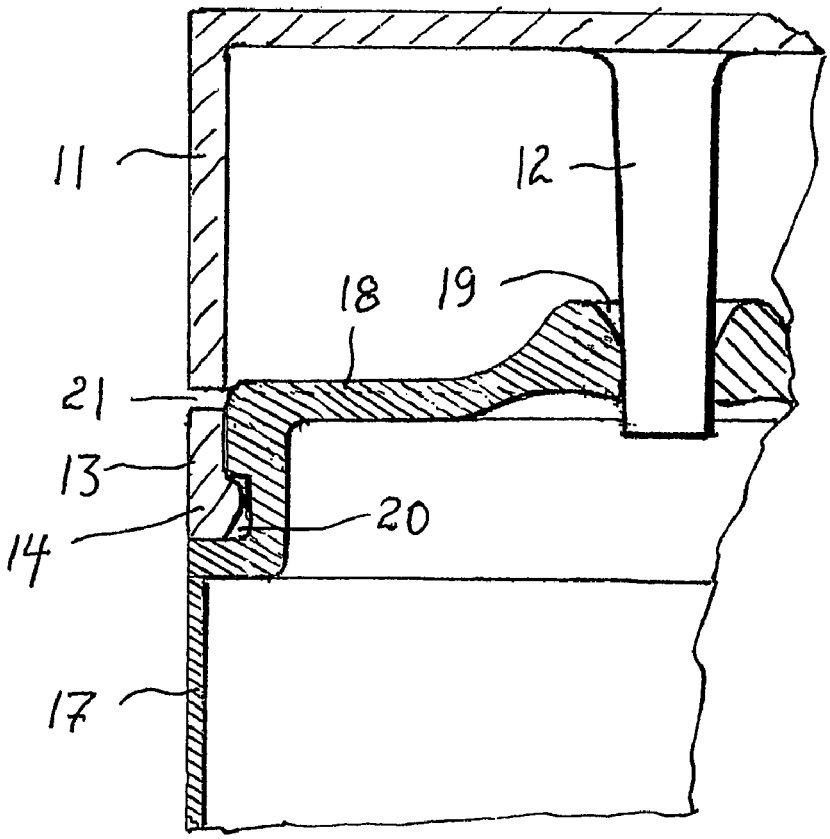
Fig. 5

METHOD FOR PROVIDING A HINGED GUARANTEE CLOSURE, A HINGED GUARANTEE CLOSURE AND CONTAINER WITH A HINGED GUARANTEE CLOSURE

The invention relates to a method for providing a hinged guarantee closure for a container, which closure comprises a cap having an integral closing member which can be brought into closing cooperation with an opening in the container.

The invention also relates to a method for providing a hinged guarantee closure on a container opening, which closure comprises a cap having an integral closing member which can be brought into closing cooperation with the container opening.

The invention also relates to a hinged guarantee closure for an opening in a container, which closure comprises a cap having an integral closing member which can be brought into cooperation with the opening.

Furthermore, the invention also relates to a container having a hinged guarantee closure for an opening in the container, which closure comprises a cap having an integral closing member which can be brought into closing cooperation with the opening.

A number of so-called guarantee closures are known, i.e., closures of the type where the user can see whether the closure is intact and that no third person has had access to the contents of the container on which the closure is used. A very common type of closure is one comprising a base member with an opening and designed for mounting on the container in question, which has a separate opening, a cap hinge-connected to the base member and an integral closing member in the cap which, in the closed position, cooperates with a corresponding opening in the base member. Such closures are as a rule injection moulded with the cap swung out, i.e., open, to the side of the base member. After removal from the mould, the base member of the closure is placed on the container. With the cap swung in, i.e., in the closed position, a connection is provided between the cap and the base member, diametrically opposite the hinge, for example, by welding. This connection provides an assurance or guarantee that the closure has not been opened before the purchaser or user opens the closure for the first time.

This prior art has a number of drawbacks. A substantial drawback is that the closure is moulded in the said swung-out state. This means that the moulding surface or pressure surface will be about twice the size of the closure surface when mounted and closed, and that the mould tool and the process machine in which the tool is arranged must be scaled up correspondingly. Moreover, before or after its mounting on the container, the closure must be brought into the closed state, which requires an extra work process. The provision of the assurance or guarantee connection also requires a separate work process.

The known embodiment having an inverted cup-shaped base member also entails extra consumption of material.

EP 0309396 describes an integral closure that is manufactured in the closed position, where the closure comprises an upper part and a lower part that are radially spaced by means of a gap extending in the joint surface which is traversed by a film hinge and an element that produces the snapping effect. The gap can also be traversed by a guarantee connection.

However, full size caps with an integral hinge and assurance/guarantee connection that are moulded in the closed position are not found in the prior art. Full size caps are highly advantageous since the tube can stand in a relatively stable manner on the cap, which means that the tube takes up little space. Tubes that do not have full size caps are stored in a horizontal position and they therefore require more space. There is therefore a need for an improved closure of the guarantee type.

The object of the invention is to be able to produce a hinged guarantee closure using a smaller moulding tool (moulding machine) in a materials-saving manner, which closure should be capable of being attached to a container in a single work process.

According to the invention there is therefore proposed a method for providing a hinged guarantee closure for a container, which closure comprises a cap having an integral closing member which can be brought into closing cooperation with an opening in the container, characterised in that the closure is injection moulded in the closed state, i.e., with a guarantee seal, the closure being injection moulded in such a form that the moulded closure will include the cap with the integral closing member and a ring member, hinge-connected and guarantee-connected to the cap, but otherwise axially spaced relative to the cap, for connection to the container.

It is especially advantageous if the ring member is injection moulded with a coupling part designed for cooperation with a coupling part on the container.

In an especially preferred embodiment, the ring member can be injection moulded with an internal circumferential snap edge as coupling part.

According to the invention there is also proposed a method for providing a hinged guarantee closure on a container opening, which closure comprises a cap having an integral closing member which can be brought into closing cooperation with the container opening, characterised in that the closure is injection moulded in the closed state, i.e., with a guarantee seal, the closure being injection moulded in such a form that the moulded closure will include the cap with the integral closing member and a ring member, hinge-connected and guarantee-connected to the cap but otherwise axially spaced relative to the cap, and made having a coupling part, and that the container is provided around its opening with a coupling part that cooperates with the coupling part of the ring member.

It is especially advantageous if the spaced ring member is made having an internal circumferential snap edge, the container then being provided with a circumferential groove around the opening, adapted to the snap edge, and that the moulded closure is pressed by means of its ring member onto the container so that the snap edge is pressed to snap into the circumferential groove.

In one embodiment of the invention, the closure may be injection moulded so that the hinge is arranged in a radially indented portion of the cap. The indented portion can advantageously be made outwardly concave.

In a particularly preferred embodiment, the closure may be injection moulded so that the hinge is in the periphery of the cap, thus ensuring that no parts of the hinge project beyond the outer diameter of the cap. When the cap is to be placed on the container, it is highly advantageous that no elements of the product project beyond the outer diameter of the cap. In addition, this gives the cap a neat appearance.

A particular advantage with these embodiments of the hinge is that projecting hinge portions are avoided and at the same time the favourable snap-over effect is obtained when the cap is opened and swung about the hinge.

According to the invention, there is also proposed a hinged guarantee closure for an opening in a container, which closure comprises a cap having an integral closing member which can be brought into cooperation with the opening, characterised in that it comprises a cap with the integral closing member and a ring member, hinge-connected and guarantee-connected to the cap but otherwise axially spaced relative to the cap, for connection with the container around the opening.

It is especially advantageous if such a hinged guarantee closure is able to have incorporated in the ring member a coupling part designed for cooperation with a coupling member on the container.

It is especially advantageous if said coupling part is in the form of an internal circumferential snap edge in the ring member.

The novel, hinged guarantee closure may according to the invention advantageously have a hinge that is arranged in a radially indented portion of the cap. The indented portion may be shaped so as to be outwardly concave.

In a particularly advantageous embodiment, the closure can be injection moulded so that the hinge is in the periphery of the cap, thus ensuring that no parts of the hinge project beyond the outer diameter of the cap. When the cap is to be put on the container, it is highly advantageous that no elements of the product project beyond the outer diameter of the cap.

In a particularly advantageous embodiment, the cap is manufactured as a full size cap.

In one advantageous embodiment of the invention, the guarantee connection is shaped so that it is easy to see whether the guarantee connection has already been broken or not, i.e., whether the cap has been opened or not.

According to the invention there is also proposed a container having a hinged guarantee closure for an opening in the container, which closure comprises a cap having an integral closing member which can be brought into closing cooperation with the opening, characterised in that the closure is injection moulded in the closed state, i.e., with a guarantee seal, and comprises a cap with the integral closing member and a ring member, hinge-connected and guarantee-connected to the cap, but otherwise axially spaced relative to the cap, and having a coupling part designed for cooperation with a coupling part on the container.

It is especially advantageous if the coupling part on the ring member can be in the form of an internal circumferential snap edge, the container having a groove extending around the opening into which the snap edge is snapped.

Because the closure is injection moulded in the closed state, that is with the cap in the closed position, it is possible to mould the closure in a smaller machine than otherwise is usual, because the moulding is done with a smaller projected surface, in reality about half of the otherwise existing moulding surface or pressure surface. A considerable materials saving is made because the base member is now reduced to a ring member and the integral closing member cooperates directly with the container opening. The guarantee connection is formed during moulding and does not therefore require a separate work process.

The shaping of a coupling part on the ring member means that the closure can simply be put in place and locked on a suitable container, i.e., a container having a corresponding coupling part. If an internal circumferential snap edge is used as coupling part on the ring member, the closure can simply be pressed in place on a suitable container, i.e., a container having a corresponding snap-in groove.

Moving the hinge axis of the hinge radially inwards will enable the cap, when opened, to be swung to a stable open position, to the side of the opening in the container.

In an especially preferred embodiment, the hinge is arranged in the periphery of the cap.

A particular advantage of the new design of the closure, in addition to the possibility of using a smaller moulding machine and the materials saving obtained, is that the injection moulded guarantee closure will be "ready" and can be placed directly on a suitable container without additional work processes.

It is also highly advantageous if the cap can be made in the form of a full size cap. It is also advantageous that no elements of the cap project beyond the outer diameter of the actual cap.

In an advantageous embodiment of the invention, the guarantee connection is made so that it is easy to see whether the guarantee connection has been broken or not, i.e., whether the cap has been opened or not.

The invention will now be explained in more detail with reference to the drawings, wherein:

FIG. 4 shows the closure when open, with the cap swung out;

FIG. 5 is an enlarged sectional view of the closure in FIGS. 2-4 fitted on a container;

Figure 1:
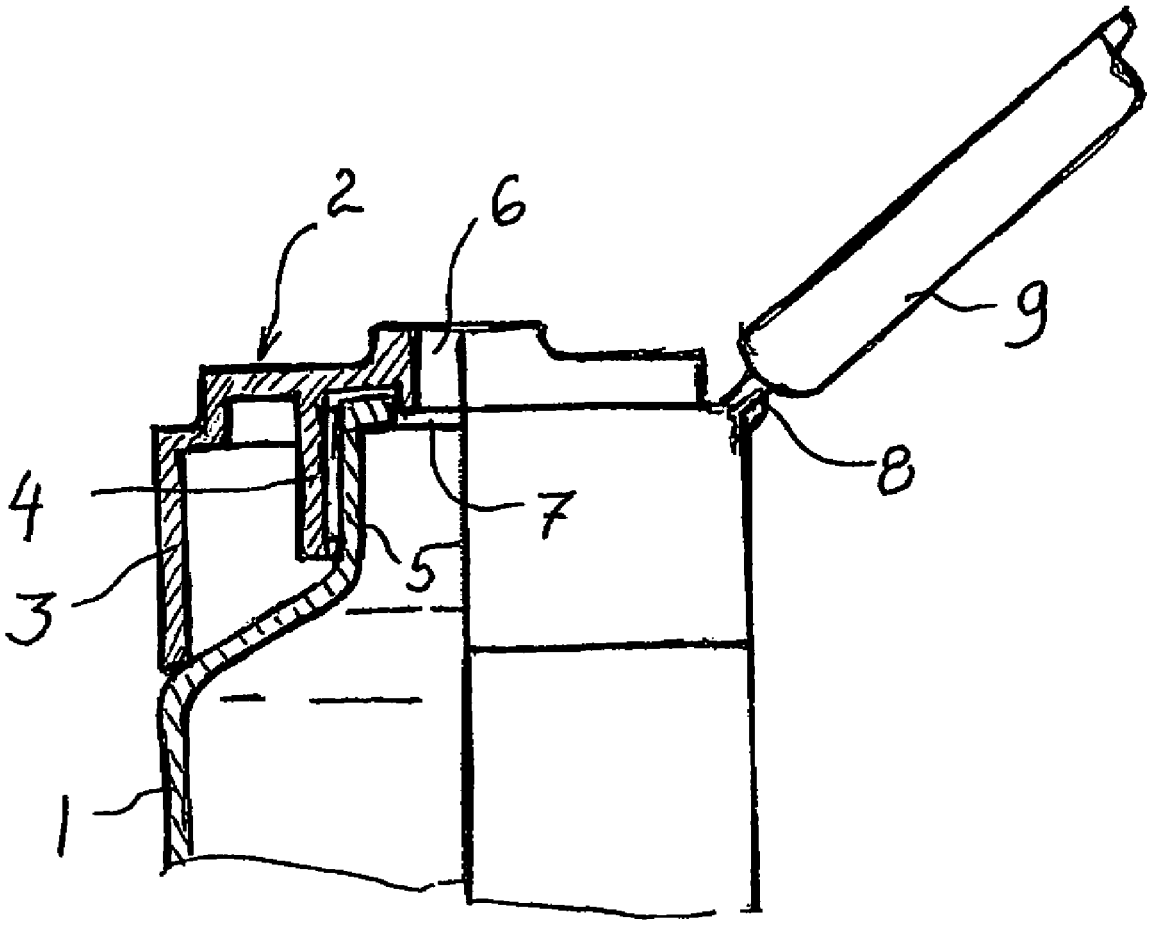
Fig. 1 (Prior art)
FIG. 1 shows a cross section through a prior art embodiment of a closure having an inverted cup-shaped base member.

FIG. 1 shows a prior art closure for a container 1. The closure 2 comprises an inverted cup-shaped base member 3 in the bottom of which is a circular-cylindrical collar 4 for cooperation with the neck 5 of the container 1. In the bottom of the inverted cup-shaped base member 3 is an opening 6 which, in the fitted state shown, will be flush with the opening 7 in the container 1. The base member 3 is hinge-connected 8 to the cap 9. It is a particular object of the invention to reduce the use of material in the base member 3 by reducing the base member to a ring body, thus also avoiding the "bottom" of the base member and the collar or support 4.

The closure according to the invention shown in FIGS. 2 to 5 comprises a cap 11, an integral closing member 12 in the cap, and a ring member 13 with an internal snap edge 14. The cap 11 is connected to the ring member 13 by an integral hinge 15, with no portions projecting beyond the periphery of the closure, and with an integral guarantee connection 16, arranged diametrically opposite the hinge 15. The guarantee connection 16 is shown broken in FIG. 4.

Figure 2:
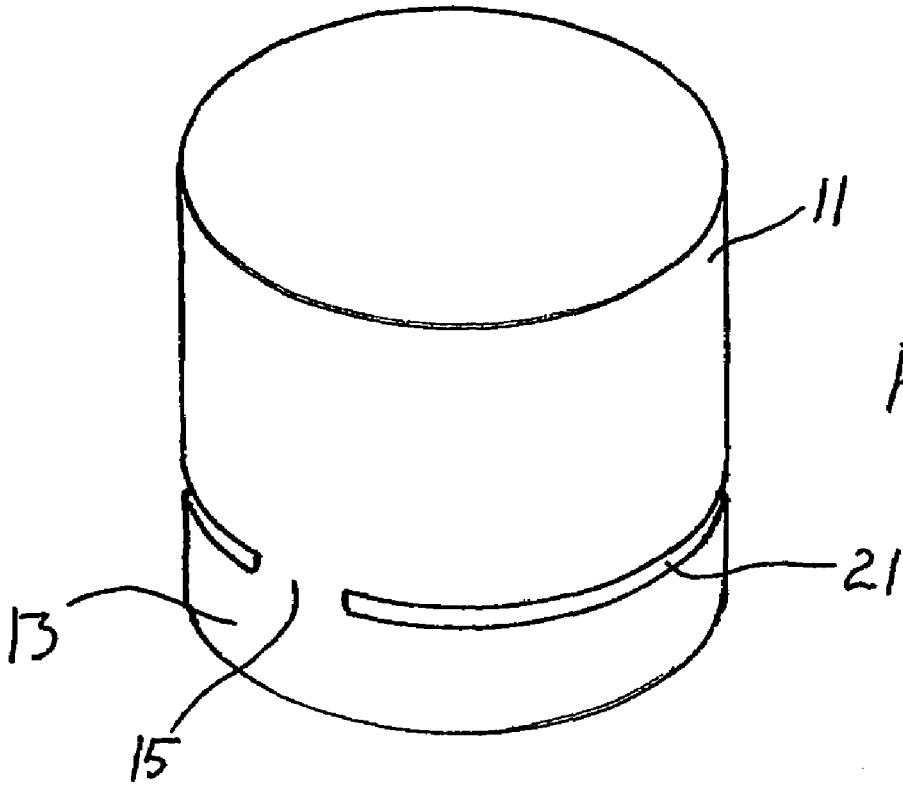
FIG. 2 shows a closure according to the invention when shut or closed.
Figure 3:
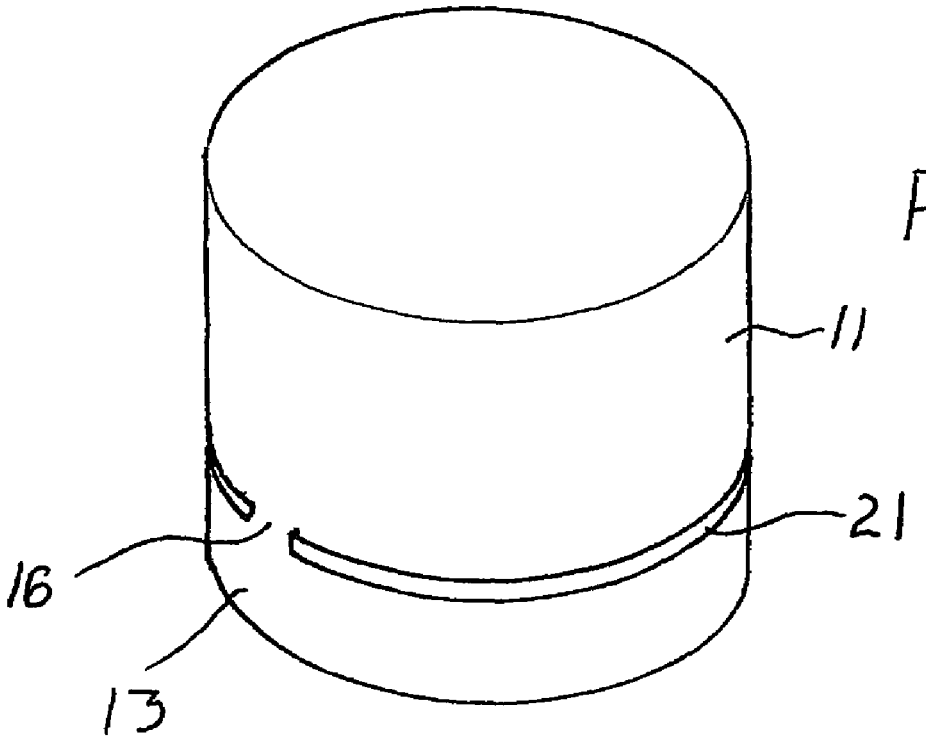
FIG. 3 shows the same closure from the opposite side.

FIG. 2 shows a highly advantageous embodiment where the integral hinge 15 is arranged in the periphery of the cap so that when the cap is closed no parts of the hinge 15 project beyond the outer diameter of the cap. This is highly advantageous during the subsequent process in which the cap is fitted on a container. In addition, it gives this cap an attractive and neat design.

FIG. 5 shows the closure placed on a container 17. The container 17 has a top wall 18 having an opening 19. The guarantee closure is pressed in place on the container 17, the snap edge 14 being brought into cooperation with a corresponding groove 20 in the container 17. The closing member 12 that is integral with the cap 11 passes into the opening 19 in the container 17 and closes this opening 19. It will be understood that when the cap 11 is swung into the open position, as in FIG. 4, the closing member 12 will move out of the opening 19 and unstop it. The section in FIG. 5 is outside the hinge 15 and the connection 16 respectively, to show the axial gap 21 between the cap 11 and the ring member 13.

The closure according to the invention shown in FIGS. 2 to 5 is injection moulded using a tool that comprises a housing and a core member that is insertable into the housing. The core defines a mould chamber together with the housing. This mould chamber is divided by a collapsible core into two chambers, i.e., a chamber in which the cap is formed and a chamber in which the ring member is formed. A collapsible core is introduced into the mould chamber and this partly closes the chambers around the core off from one another, so that a mould section is created in which the hinge or guarantee connection will be formed. The collapsible core will form the axial gap between the cap and the ring member. This involves the application of injection moulding technique that is known per se.

The snap edge 14 is produced in that the core is provided with a circumferential recess. The elasticity of the moulding materials allows the core to be withdrawn without any difficulty. Optionally, a more or less collapsible core may also be used, as will be known to the person skilled in the art of injection moulding.

After the injection moulding, there is a guarantee closure which can be broken by the first-time user, by breaking the connection 16. This is done in a common manner in that the cap 11 is swung about the hinge 15.

The closing member 12 is shown in this case as a pin which passes into the opening 19 in the container. Of course, the closing member may be of another suitable design, and may, for instance be in the form of an annular projection which on closing comes to rest around an elevation around the opening.

Figure 6:
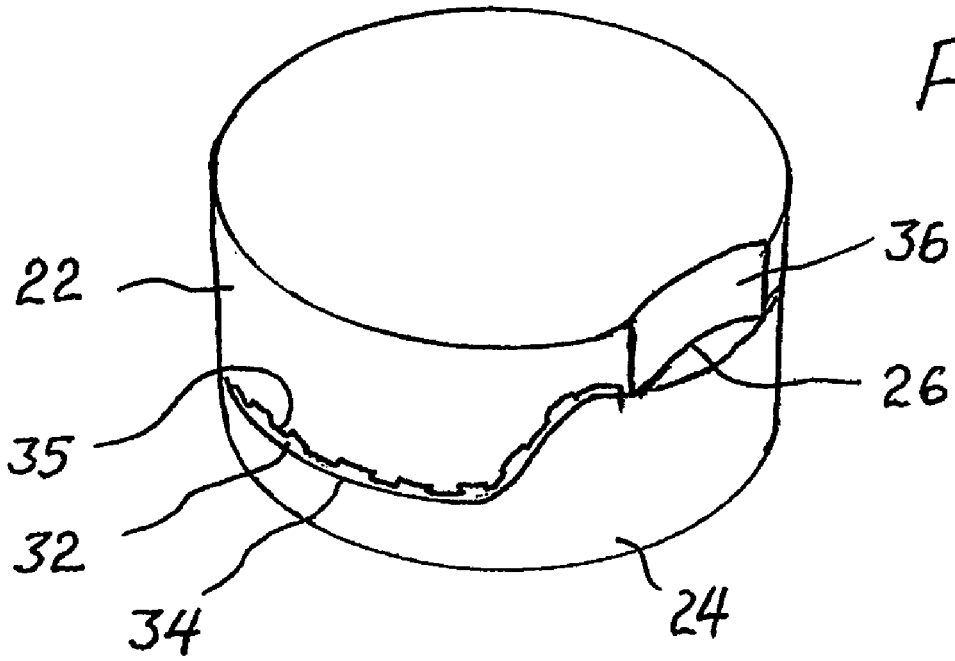
FIG. 6 shows a second closure according to the invention.
Figure 7:
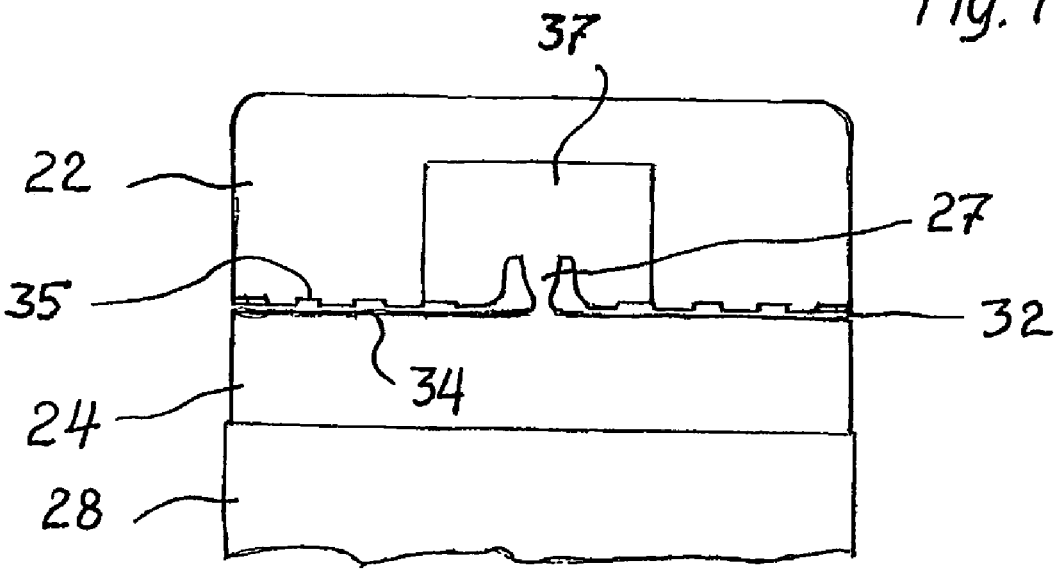
FIG. 7 is a view of the closure in FIG. 6, seen from the opposite side.
Figure 8:
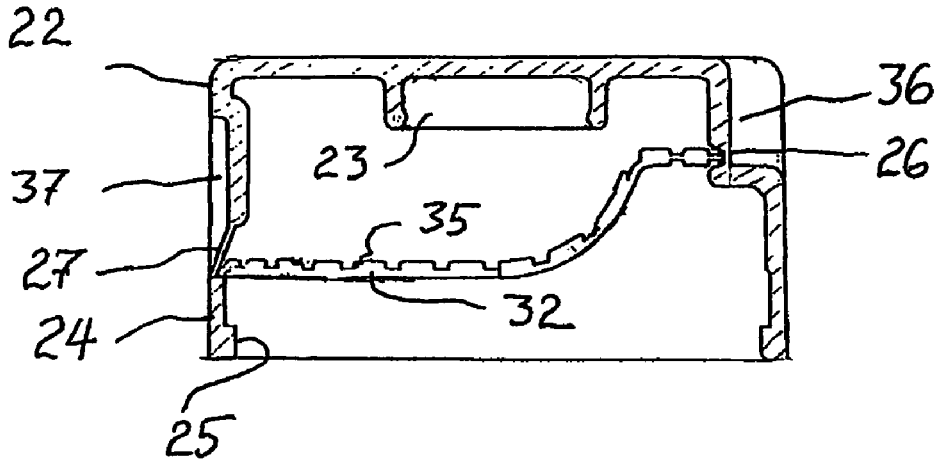
FIG. 8 is a sectional view through the closure in FIGS. 6 and 7.

FIGS. 6 to 8 show a second embodiment of the closure according to the invention. The closure shown in FIGS. 6 to 9 comprises a cap 22, an integral closing member 23 in the cap 22, and a ring member 24 having an internal snap edge 25. The cap 22 is connected to the ring member 24 by an integral hinge 26 and by an integral guarantee connection 27, arranged diametrically opposite the hinge 26. The guarantee connection 27 is shown broken in FIG. 9.

Figure 9:
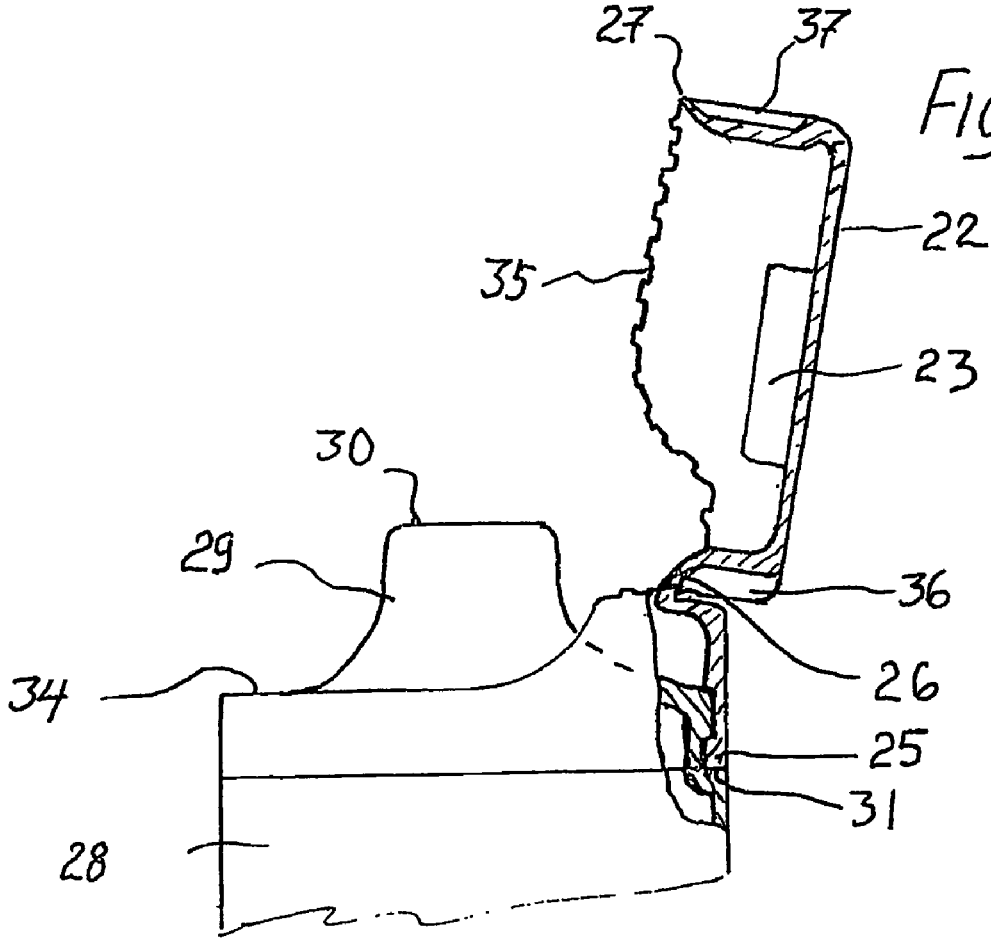
FIG. 9 is a sectional view like that in FIG. 8, but with the cap broken loose and swung upwards, so that the container opening is exposed.

In FIGS. 7 to 9 the closure is shown fitted on a container 28. The container has a top wall 29 having a more or less spout-shaped opening 30, which in the closed position will cooperate with the closing member 23 in the cap 22. The closure has been pressed in place on the container 28, the snap edge 25 being brought into cooperation with a corresponding groove 31 in the container 28.

Between the cap 22 and the ring member 24 there is an axial gap 32 which on the ring member side is limited by a smooth end edge 34 on the ring member, and on the cap side is limited by a notched edge 35 on the cap.

The object of the special embodiment of the gap 32 is to limit the compression of the gap with associated load on the hinge and the guarantee closure when the closure is pressed onto the container, whilst in alternating portions along the gap there is a greater distance which gives more material in the projections that are arranged on the collapsible core used during an injection moulding of a closure of the type shown in FIGS. 6 and 7.

As shown, the hinge 26 is arranged in a radially indented portion 36 of the cap wall. Advantageously, the hinge 26 follows an outwardly concave curve. A design of this kind is favourable in order to give a snap or dead point effect when the cap 22 is swung about the hinge 26, i.e., opened as shown in FIG. 9. The same advantageous effect is obtained as with the known material hinges which comprise portions projecting beyond the periphery of the cap. For reasons more related to design, the gap 32 has been drawn up somewhat, or into the cap 22 at the hinge 26. In addition, the smooth ring member edge 34 is flush with the container body, so as to prevent remains of the contents from becoming stuck there.

To facilitate the opening of the cap, it is provided in a known way with a slightly indented finger portion 37. The actual guarantee connection 27 is shown in particular in FIGS. 7 and 8.

The closure shown in FIGS. 6 to 9 can be injection moulded using a collapsible core so that the shaping of various undercuts etc. is permitted. The use of an injection mould with collapsible core is well known to the skilled person, but as an example reference will nevertheless be made to U.S. Pat. No. 3,247,548.

Of course, instead of the snap edge 14 (see FIGS. 4 and 5) and the snap edge 25 (see FIGS. 8 and 9), other suitable coupling means may be used. For instance, the use of cooperating screw threads which can be injection moulded without any difficulty by using a collapsible core would be possible, or, for example, a bayonet fastening. However, the illustrated snap edge connection, which could optionally be reversed, is advantageous because the closure can then simply be pressed axially onto the container and snapped into place.

Figure 10:
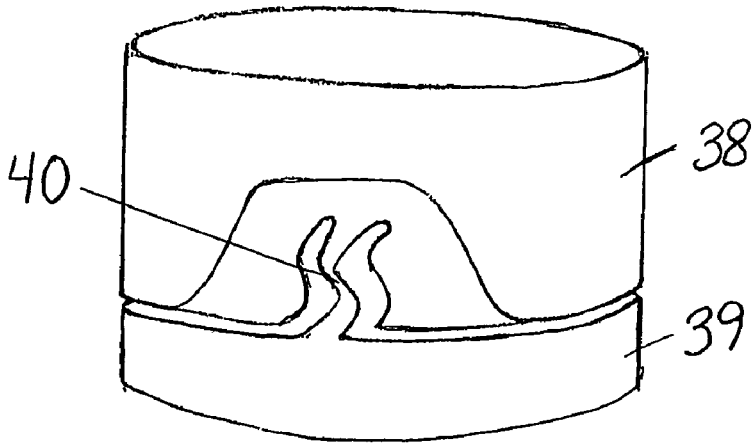
FIG. 10 shows a third closure according to the invention.
Figure 11:
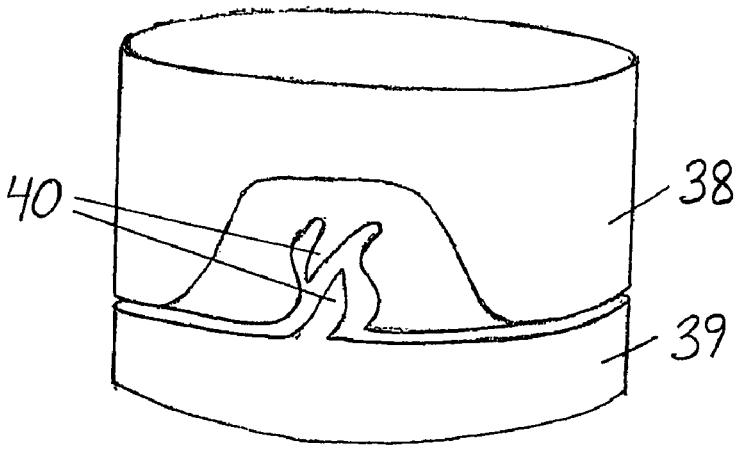
FIG. 11 shows the closure in FIG. 10 with broken guarantee connection.

FIGS. 10 and 11 show another advantageous embodiment of a hinged guarantee closure comprising a cap 38, and a ring member 39 axially separated relative to the cap, where there is another design of the guarantee connection 40 from which it can be seen whether the guarantee connection 40 has been broken or not. In FIG. 10 the closure is shown with an unbroken guarantee connection 40, i.e., that the cap has not previously be opened. FIG. 11 shows the same closure as in FIG. 10, but now with a broken guarantee connection 40. This design of the guarantee connection 40 makes its clear to a user whether the cap has already been opened or not.

A major advantage obtained with the invention is the simplified and materials-saving closure embodiment compared, for example, with the known embodiment shown in FIG. 1, as it can be seen that by using a ring member, the bottom of the known inverted cup member is avoided and this results in materials saving. The projected surface or pressure surface in the injection moulding tool is also greatly reduced compared with the prior art, to about half, with the associated advantages as regards the sizing of tools and moulding machine.

Another major advantage obtained with the invention is that the integral cap can be made as a full size cap where none of the elements of the cap project beyond the outer periphery of the cap.

The invention claimed is:

1. A method for providing a hinged guarantee closure for a container, said closure comprising a non-threaded cap having an integral closing member for closing cooperation with an opening in said container, and a ring member for connection to said container, the ring member encircles the container at a position such that the ring member is prevented from moving axially relative to the container, the method comprising injection moulding the guarantee closure in a closed state, with a guarantee seal, the closure being injection moulded, by using a mould having a collapsible core, in such a form that the moulded closure comprises said cap and said ring member, connected by a hinge element and at least one guarantee connection, axially spaced from each other, whereby said guarantee connection is formed generally flush with exterior surfaces of the cap and ring members; the hinge element is located at a periphery of the cap.

2. The method of claim 1, wherein the ring member is injection moulded with a coupling part that cooperates with a coupling part on the container.

3. The method of claim 2, wherein the ring member is injection moulded having an internal circumferential snap edge.

4. The method of claim 1, wherein the guarantee connection is made so that it is clear whether the guarantee connection has been broken or not.

5. A method for providing a hinged guarantee closure on a container opening, said closure comprising a non-threaded cap having an integral closing member for closing cooperation with the container opening and a ring member for connection to the container, the ring member encircles the container at a position such that the ring member is prevented from moving axially relative to the container, the method comprising injection moulding the closure in a closed state, with a guarantee seal, the closure being injection moulded, by using a mould having a collapsible core, in such a form that the moulded closure comprises the cap with the integral closing member and the ring member, connected by a hinge and guarantee connection connected to the cap, and axially spaced relative to the cap, the hinge is located at a periphery of the cap, and the closure is made having a coupling part, whereby the guarantee connection is formed generally flush with exterior surfaces of the cap and ring members and the container is provided with a coupling part that cooperates therewith.

6. The method of claim 5, wherein the ring member has an internal circumferential snap edge, that the container is provided with a circumferential groove around the opening, adapted to the snap edge, and that the moulded closure is pressed with its ring member onto the container so that the snap edge is pressed to snap into the circumferential groove.

7. The method of claim 5, wherein the guarantee connection is made so that it is clear whether the guarantee connection has been broken or not.

8. The method of claim 5, wherein the hinge is made in a radially indented portion of the cap.

9. The method of claim 8, wherein the indented portion is outwardly concave.

10. The method of claim 1, using the collapsible core to divide the mould chamber into two chamber parts, a first chamber part in which the cap is formed and a second chamber part in which the ring member is formed.

11. The method of claim 10, wherein the collapsible core partly closes the first and second chamber parts off from one another, so that a mould section is formed between the chamber parts, in which mould section the hinge and guarantee connection is formed.

12. The method of claim 10, wherein the collapsible core fills the axial space between the cap and the ring member.

13. The method of claim 10, wherein the collapsible core is provided with a circumferential recess that forms a snap edge providing the connection between the ring member and the container.

14. The method of claim 5, using the collapsible core to divide the mould chamber into two chamber parts, a first chamber part in which the cap is formed and a second chamber part in which the ring member is formed.

15. The method of claim 14, wherein the collapsible core partly closes the first and second chamber parts off from one another, so that a mould section is formed between the chamber parts, in which mould section the hinge and guarantee connection is formed.

16. The method of claim 14, wherein the collapsible core fills the axial space between the cap and the ring member.

17. The method of claim 14, wherein the collapsible core is provided with a circumferential recess that forms a snap edge providing the connection between the ring member and the container.

18. The method of claim 1, further comprising the step of dividing the mould into two chamber parts, a first chamber part in which the cap is formed and a second chamber part in which the ring member is formed.

19. The method of claim 5, further comprising the step of dividing the mould into two chamber parts, a first chamber part in which the cap is formed and a second chamber part in which the ring member is formed.

* * * * *